US011834930B2

(12) United States Patent
Maini et al.

(10) Patent No.: US 11,834,930 B2
(45) Date of Patent: Dec. 5, 2023

(54) SOCK FOR A FLOATING VESSEL

(71) Applicant: ZENTECH, INC., Houston, TX (US)

(72) Inventors: Ramesh Maini, Houston, TX (US); Hans Deul, Richmond, TX (US); Partha Chakrabarti, Katy, TX (US); Abhijeet Chawan, Katy, TX (US); Ratheesh Ravi, Katy, TX (US); Kaushik Bose, Katy, TX (US); Paul Barker, Houston, TX (US)

(73) Assignee: Zentech, Inc., Houston, TX (US)

( * ) Notice: Subject to any disclaimer, the term of this patent is extended or adjusted under 35 U.S.C. 154(b) by 331 days.

(21) Appl. No.: 17/416,251

(22) PCT Filed: Dec. 20, 2019

(86) PCT No.: PCT/US2019/068137
§ 371 (c)(1),
(2) Date: Jun. 18, 2021

(87) PCT Pub. No.: WO2020/132624
PCT Pub. Date: Jun. 25, 2020

(65) Prior Publication Data

US 2022/0074283 A1 Mar. 10, 2022

Related U.S. Application Data

(60) Provisional application No. 62/784,254, filed on Dec. 21, 2018.

(51) Int. Cl.
*E21B 19/00* (2006.01)
*E21B 19/02* (2006.01)
(Continued)

(52) U.S. Cl.
CPC ..... *E21B 40/00* (2013.01); *B63B 35/4413* (2013.01); *E21B 19/002* (2013.01);
(Continued)

(58) Field of Classification Search
CPC ..... E21B 19/002; E21B 19/02; E21B 19/16; E21B 25/18; E21B 40/00; B63B 35/4413
See application file for complete search history.

(56) References Cited

U.S. PATENT DOCUMENTS 3,966,054 A * 6/1976 Kelly ..... E21B 19/14 211/70.4
4,160,060 A * 7/1979 Bynum, Jr. ..... E02B 17/00 166/364
(Continued)

FOREIGN PATENT DOCUMENTS

KR 20140010692 A 1/2014
KR 20140083434 A 7/2014
(Continued)

OTHER PUBLICATIONS

International Search Report and Written Opinion dated Mar. 19, 2020 for PCT/US2019/68137.

*Primary Examiner* — Matthew R Buck
(74) *Attorney, Agent, or Firm* — Patterson + Sheridan, LLP

(57) ABSTRACT

A sock for a floating platform including a plurality of tubulars coupled together and defining a bore and a catcher assembly. The catcher assembly including a plurality of orifices formed in at least one of the plurality of tubulars, a catcher releasably coupled to the plurality of tubulars by a plurality of shearable members, wherein the catcher is disposed in the bore, and wherein the catcher is movable from a first position to a second position, and a stop flange having at least one aperture.

20 Claims, 10 Drawing Sheets

(51) Int. Cl.

| | |
|---|---|
| ***E21B 19/16*** | (2006.01) |
| ***E21B 25/18*** | (2006.01) |
| ***E21B 40/00*** | (2006.01) |
| ***B63B 35/44*** | (2006.01) |

(52) U.S. Cl.
CPC ..... *E21B 19/02* (2013.01); *E21B 25/18* (2013.01); *E21B 19/16* (2013.01)

(56) References Cited

U.S. PATENT DOCUMENTS

| | | | | |
|---|---|---|---|---|
| 7,287,935 | B1 | 10/2007 | Gehring | |
| 9,145,759 | B2 * | 9/2015 | Webb | E21B 41/0021 |
| 9,303,468 | B2 * | 4/2016 | Selzer | E21B 19/14 |
| 2008/0149342 | A1 | 6/2008 | Olsen | |
| 2011/0233017 | A1 * | 9/2011 | Pedersen | E21B 19/00 188/377 |
| 2016/0194924 | A1 * | 7/2016 | Pinto | E21B 19/00 166/75.11 |

FOREIGN PATENT DOCUMENTS

| | | | | |
|---|---|---|---|---|
| KR | 101516207 | B1 * | 5/2015 | |
| KR | 20170001301 | A | 1/2017 | |
| KR | 20170001301 | U * | 4/2017 | |
| WO | WO-2011083028 | A2 * | 7/2011 | E21B 19/00 |

* cited by examiner

SOCK FOR A FLOATING VESSEL

CROSS-REFERENCE TO RELATED APPLICATIONS

This application claims the benefit of U.S. Provisional Patent Application Ser. No. 62/784,254, filed Dec. 21, 2018, which is herein incorporated by reference in its entirety.

BACKGROUND

Field

Embodiments of the present disclosure generally relate to a sock for the assembly of multiple joints of pipe, collars, and/or casings on a floating vessel, such as an offshore rig. The sock has an assembly to catch a dropped joint or section.

Additionally, embodiments of the present disclosure generally relate to a sock for core sample retrieval operations on the floating vessel.

Description of Related Art

Multiple joints of pipe, collars, or casing are often assembled in a sock, such as a shuck, of an offshore drilling rig and are then transferred directly to the well or to a setback. A joint is the length of one pipe, collar, or casing. A section (e.g., multiple joint, stand) includes multiple individual joints. For example, a section of drill pipe is assembled by threading two or more drill pipes together. The section may be a double, triple, or quadruple. For example, during a drilling operation, a section of drill pipe can be added to the drilling string from the setback.

Once a section is assembled in the sock, it is transferred to the setback or directly to the existing string inside the well. However, it is possible that the section, such as a section of drill pipe, may be dropped before the section is removed from the sock. A single joint may also be dropped while the section is being assembled in the sock. The weight of the single joint or section and the height from which the single joint or section is dropped can result in the dropped single joint or section impacting the sock and causing the sock to fail, resulting in the dropped single joint or section exiting the sock. As a result, the dropped single joint or section of drill pipe can fall to the bottom of the ocean and cause damage to the wellhead, blowout preventers, and/or other equipment on the seafloor.

Some socks have a spring mechanism that attempts to slow a dropped single joint or section. However, the springs become damaged as a result of the operation and require a lengthy and expensive repair operation. There is a need for a sock that can catch a dropped single and/or section without allowing the single joint or section to fall to the sea floor. There is also a need for a sock that can catch a dropped single joint or section that has a reduced time and cost to return the sock into service after catching the dropped single joint or section.

Prior to drilling a wellbore, core samples of the seabed are taken. The core samples are used to determine the physical properties of the seabed, which are used to design and construct the wellbore. The water content of the core sample is used to determine certain physical characteristics of the seabed. Additionally, the core samples may be delicate and ideally have minimal disturbances due to storage and handling. For example, excessive jarring of the core sample at the surface may disturb the striation of the sediments in the sample. Disturbances to the core sample may occur when the core sample is horizontally orientated. The core samples may be several feet long. For example, some cores may be 80 ft (about 24.38 m) or more in length. The core samples are collected using a coring tool string, which includes a coring tool connected at the end of a tubular string, such as a drill sting. In order to retrieve the core sample from the wellbore, the joints of the tubular string are removed one section or joint at a time.

There is also need for sock that can be suspended from the offshore rig and be at least partially submerged in the sea while providing a vertical and dry environment for disassembling a coring tool string and or storing a core sample disposed in a coring tool.

SUMMARY

In one embodiment, a sock for a floating platform includes a plurality of tubulars coupled together and defining a bore, and a catching assembly. The catching assembly includes a plurality of orifices formed in at least one of the plurality of tubulars. The catching assembly further includes a catcher releasably coupled to the plurality of tubulars by a plurality of shearable members, wherein the catcher is disposed in the bore, and wherein the catcher is movable from a first position to a second position. The catching assembly further includes a stop flange having at least one aperture.

In one embodiment, a method of using a sock on a floating platform includes disposing a sock having a catcher, a stop flange having an aperture, and a plurality of orifices at least partially in a body of water, wherein the catcher is maintained in a first position by a plurality of shearable members. The method further includes releasing the catcher from the first position by shearing the plurality of shearable members in response to an impact of a dropped joint with a portion of the catcher. The method further includes displacing a column of water from a bore of the sock through at least one of the plurality of orifices and the aperture in response to the catcher descending in the bore. The method further includes engaging the catcher with the stop flange.

In one embodiment, a sock for a core retrieval operation includes a first portion including one or more tubulars and a second portion. The second portion includes a first tubular having a upper end and a lower end, wherein the upper end is open and the lower end is closed. The second portion further includes a coupling connected to the upper end configured to couple the second portion to the first portion. The second portion further includes at least one sealing member configured to seal the coupling between the first portion and the second portion. The second portion further includes a valve coupled to the lower end, the valve configured to selectively allow fluid communication with an interior of the first tubular.

BRIEF DESCRIPTION OF THE DRAWINGS

FIG. 2A illustrates a partial cross section of the sock. FIG. 2B illustrates a cross section of an upper end of the sock. FIG. 2C illustrates a support structure of the sock.

FIG. 3A is a top view of the cart. FIG. 3B is a side view of the cart.

FIG. 10A is a top view of the installation tool. FIG. 10B is a cross-sectional view of the installation tool.

While the foregoing is directed to embodiments of the present disclosure, other and further embodiments of the disclosure may be devised without departing from the basic scope thereof, and the scope thereof is determined by the claims that follow.

DETAILED DESCRIPTION

Figure 1:
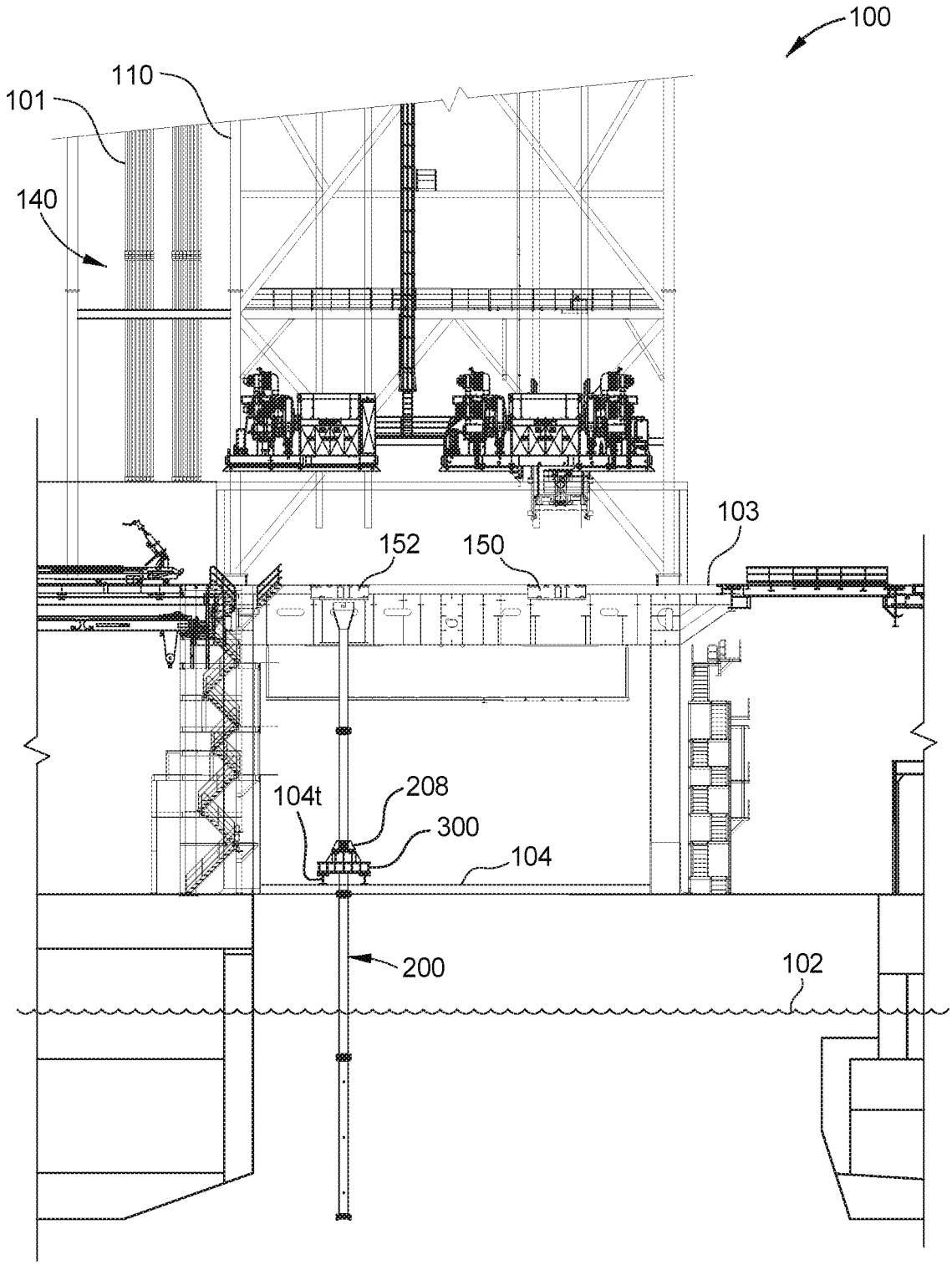
FIG. 1 illustrates an offshore rig with a sock.

FIG. 1 shows a partial cross section of an exemplary offshore rig 100 having a sock 200 for assembling sections 101 of multiple joints of pipe. For the purposes of this application, a section 101 includes multiple individual joints 101*j* of pipe, collars, and/or casing. The sections 101 can be formed from drill pipe, casing pipe, production pipe, or other pipe used in oil drilling, exploration, or production.

As shown in FIG. 1, the offshore rig 100 is shown at sea 102. The offshore rig 100 includes a drill floor 103, a moon pool deck 104, a derrick 110, a setback 140, a first rotary table 150, and a second rotary table 152. The offshore rig 100 may include a rail and crane system that may be used to assemble the sections in the sock 200 and to remove the assembled sections from the sock 200 for transfer to the setback 140 or transfer directly to the string in the wellbore. In some embodiments and as shown in FIG. 1, the sock 200 is disposed below the second rotary table 152. For example, the first rotary table 150 is used for a drilling operation while second rotary table 152 may be incorporated into an operation to assemble sections 101 of drill pipe in the sock 200 for use in the drilling operation, A cart 300 may be moveable along tracks 104*t* disposed on the moon pool deck 104. As shown in FIG. 1, the sock 200 is partially submerged in the sea 102.

Figure 2A:
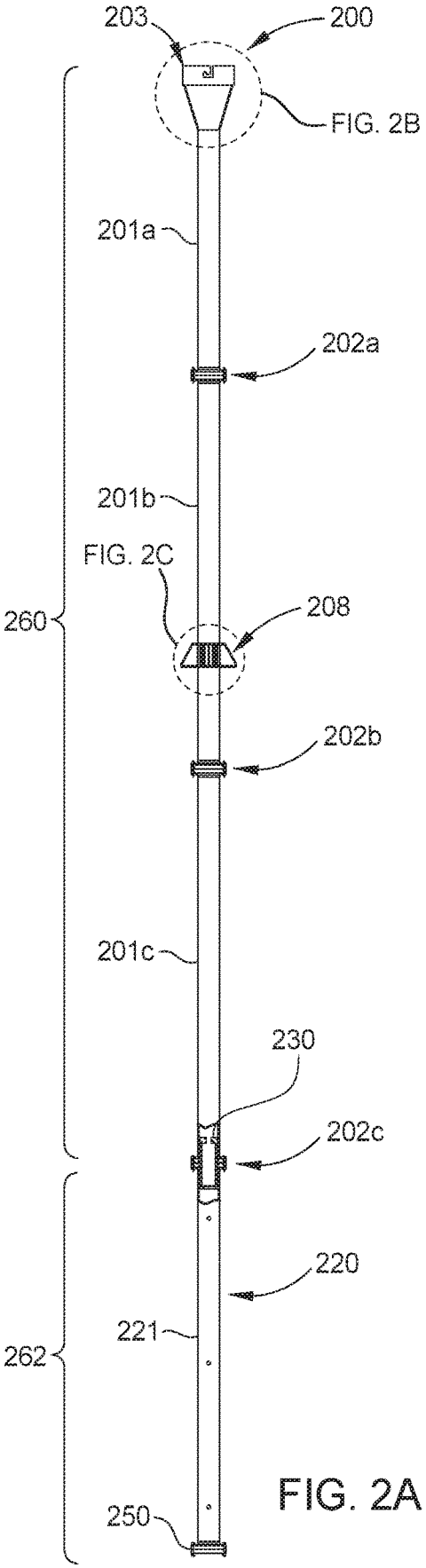
FIGS. 2A-2C illustrate the sock.
Figure 2B:
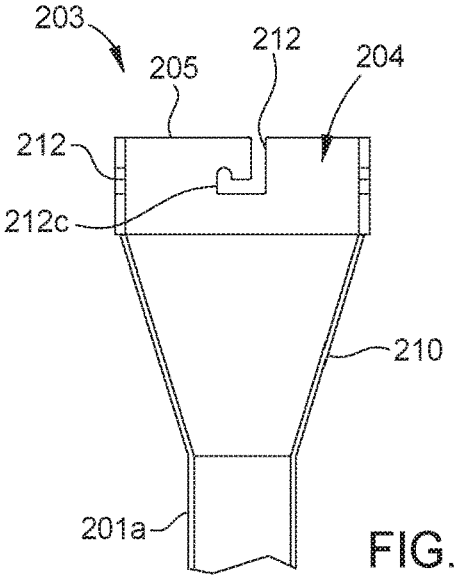
Figure 2C:
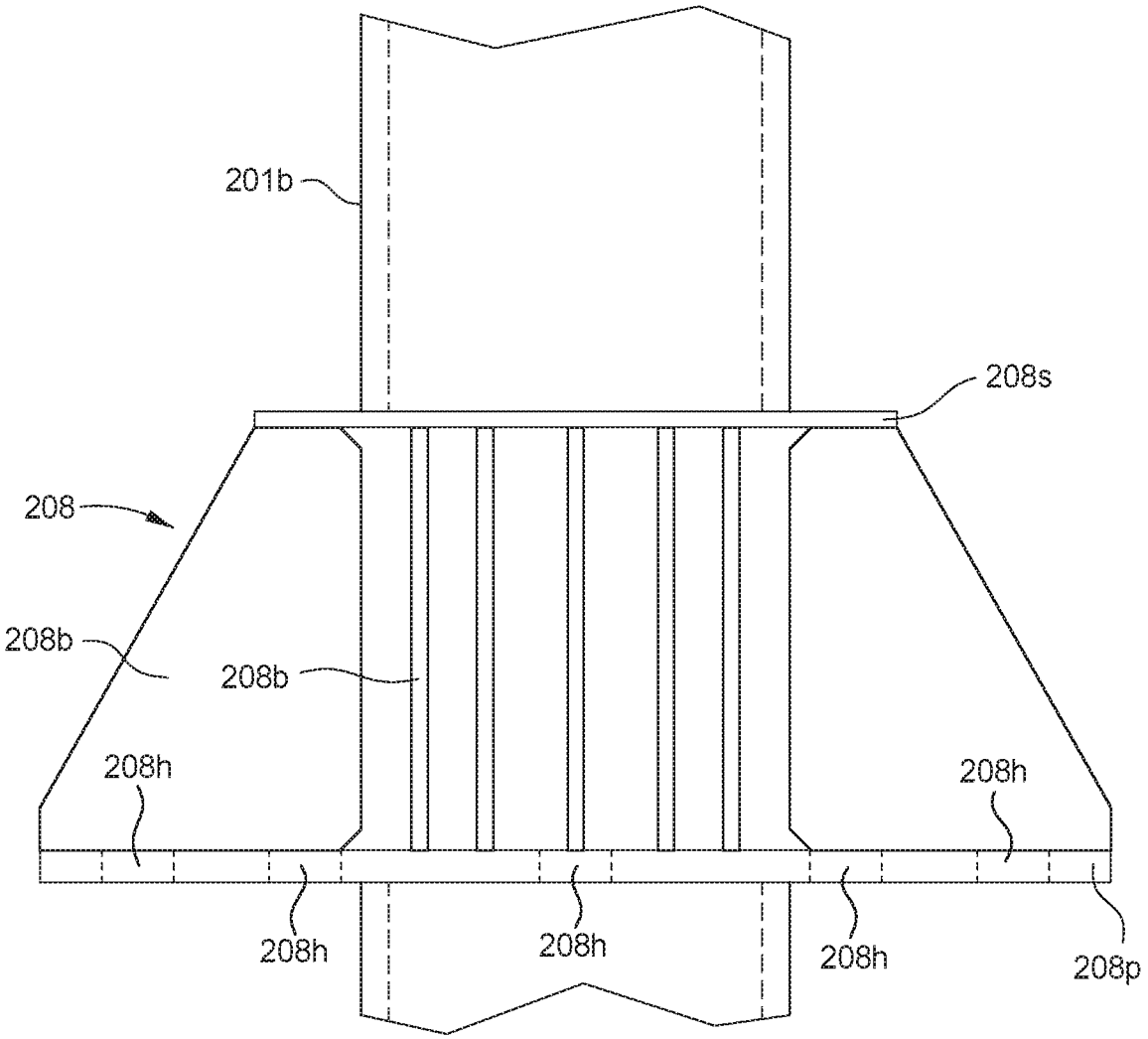

FIG. 2A-2C illustrates the sock 200 shown in FIG. 1. The sock 200 includes tubulars 201*a-c* and a catching assembly 220. As shown in FIG. 2A, the tubulars 201*a*, 201*b* are connected together by a flange connection 202*a*. Tubulars 201*b*, 201*c* are connected together by a flanged connection 202*b*. The sock 200 further includes a bore 204. In some embodiments, the sock 200 includes a support structure 208. The upper end 203 of the sock 200 has an opening 205. In some embodiments, and as shown in FIG. 2A, the upper end 203 of the sock 200 is a cone shaped member 210 connected to or integral with the tubular 201*a*. FIG. 2B better illustrates the upper end 203. The generally cone shaped member 210 may guide a dropped section 101 into the sock 200. In some embodiments, the upper end 203 includes slots 212 configured to allow an installation tool 500 (FIGS. 10A-B) to couple with the sock 200. As shown in FIG. 2B, the slots 212 are formed in the cone shaped member 210. The slots 212 may be a j-slot with a curve 212*c*. When the installation tool 500 is coupled to the upper end 203, the sock 200 can be raised, lowered, and/or moved around the offshore rig 100.

As shown in FIG. 2A, the sock 200 has a first portion 260 and a second portion 262. The first portion 260 includes the tubulars 201*a-c*, upper end 203, and support structure 208. The catching assembly 220 forms the second portion 262 of the sock 200. The catching assembly 220 is connected to the lower end of the first portion 260. As shown in FIG. 2A, the catching assembly 220 is connected to the tubular 201*c* by a flanged connection 202*c*. When assembling a section 101, a portion of the section 101 is at least disposed in the sock 200. The section 101 or the first individual joint 101*j* is inserted into the sock 200 through the opening 205.

In some embodiments, the sock 200 includes a support structure 208. As shown in FIG. 2C, the support structure 208 includes a flange plate 208*p*, a support plate 208*s*, and brackets 208*b*. The support structure 208 may be attached to or integral with the tubular 201*b*. In some embodiments, the support structure 208 is welded to the tubular 201*b*. The support structure 208 is disposed about the exterior of the tubular 201*b*, The flange plate 208*p* may include a plurality of fastener holes 208*h*.

In some embodiments, and as shown in FIG. 1, the sock 200 is partially disposed within the cart 300 that is movable on the moon pool deck 104. In some embodiments, the cart 300 is a blowout prevent (BOP) cart. In some embodiments, and as shown in FIG. 1, the sock 200 is supported by the cart 300, and thus the cart 300 is configured to support the weight of the sock 200 and a dropped single joint 101*j* and/or section 101.

Figure 3A:
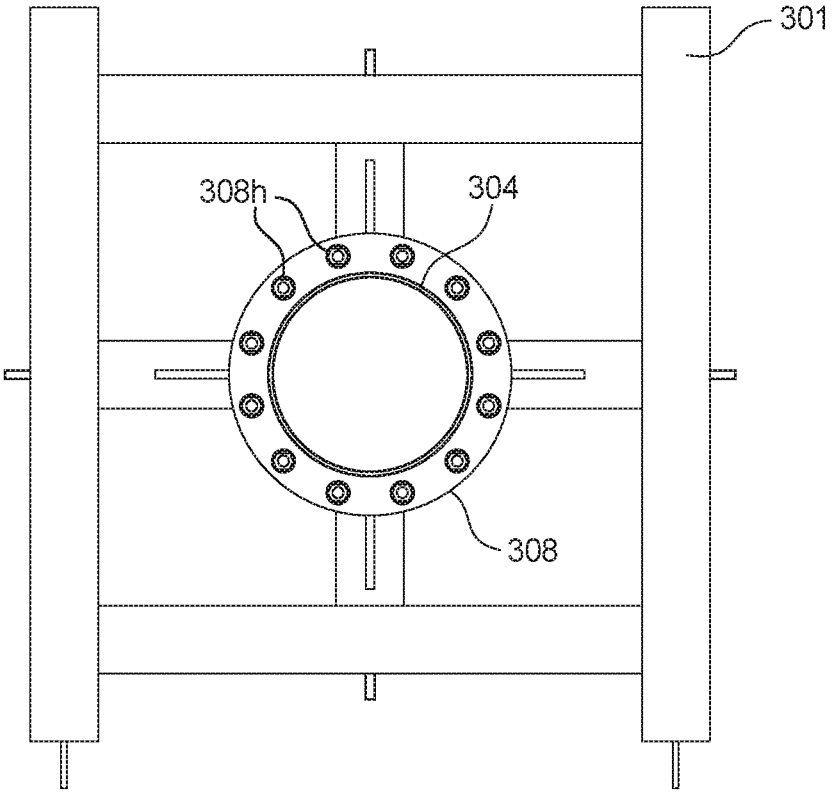
FIG. 3A-3B illustrates a cart configured to support the sock.
Figure 3B:
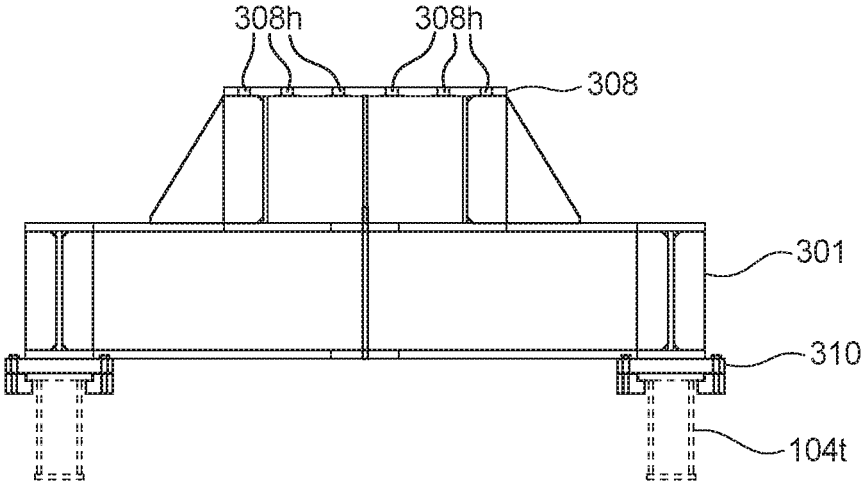

FIG. 3A-B illustrates the cart 300. The cart includes a frame 301, a central bore 304, and a support structure 308. The cart 300 may be configured to travel along tracks 104*t* disposed on the moon pool deck 104. One or more clamps 310 may be coupled to the frame 301. The clamps 310 may be engaged with a respective track 104*t* to hold the cart 300 in a fixed position on the tracks 104*t* (shown as the dashed lines). The support structure 308 may be connected to or integral with the frame 301. The support structure 308 may be a flange. The support structure 308 may include fastener holes 308*h*. The support structure 308 is configured to engage with the corresponding support structure 208 of the sock 200. The support structures 208, 308 may be fastened together. For example, the flange plate 208*p* may be bolted to the support structure 308 by disposing bolts in the fasteners holes 208*h*, 308*h*. The cart 300 supports the weight of the sock 200 when the corresponding support structures 208, 308 are engaged. The sock 200 is insertable into the cart 300 via the bore 304. Alternatively, the weight of the sock 200 is supported by slips which grip a tubular 201, such as tubular 201*a*, or grip the upper end 203 of the sock 200. For example, a spider with slips may grip tubular 201*a*.

The catching assembly 220 includes a catcher 230, a tubular 221, and a stop flange 250. As shown in FIG. 2, the stop flange 250 is disposed at the lower end of the sock 200. The tubular 221 is connected to the tubular 201*c* by the flange connection 202*c*. The tubular 221 includes a plurality of orifices 228 formed in the wall of the tubular 221. Thus, ocean water may flow into and out of the bore 204 via the plurality of orifices 228. In some embodiments, the each orifice 228 of the plurality of orifices 228 is about 0.5 inches (about 1.27 cm) to about 3 inches (about 7.62 cm) in diameter. In some embodiments, each orifice 228 of the plurality of orifices 228 may be all about the same diameter. In some embodiments, each orifice 228 of the plurality of orifices 228 may be various different diameters. In some embodiments, the orifices 228 are spaced along the length and about the circumference of the tubular 221.

Figure 4:
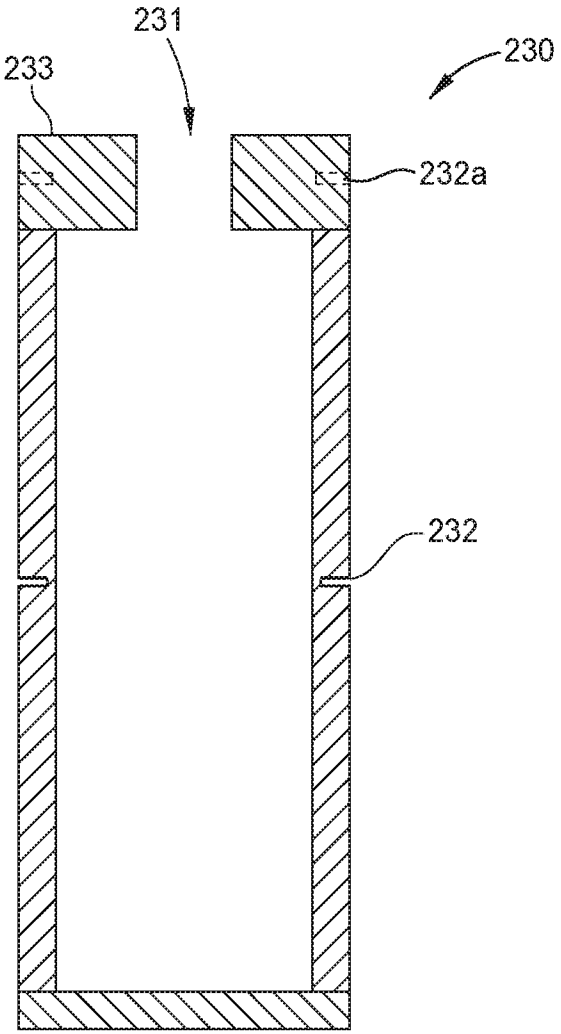
FIG. 4 illustrates a cross section of a catcher of the catching assembly.

A cross section of the catcher 230 is shown in FIG. 4. In some embodiments, the catcher 230 may be made of high strength steel and may be about 1000 lbs (about 453.59 kg). The catcher 230 is disposed within the bore 204 when the sock 200 is assembled. In some embodiments, and as shown in FIG. 4, one end of the catcher 230 includes an opening 231 configured to receive a portion of a dropped joint 101*j* or section 101. The catcher 230 further includes an upper surface 233. In some embodiments, the opening 231 may be configured to allow a lifting tool to lift the catcher 230 into position. In some embodiments, the dropped joint 101*j* or section 101 contacts the upper surface 233 instead of being received in the opening 231. In some embodiments, the catcher 230 has a plurality of blind bores 232 configured to receive a portion of a corresponding shearable member 240 of a plurality of shearable members 240, such as a spring loaded shear pin. In some embodiments, the catcher 230 has a circumferential groove configured to receive a portion of the shearable members 240 instead of the blind bores 232. The blind bores 232 (or circumferential grove) may be formed at any location along the longitudinal axis of the catcher 230. For example, the bores 232 may be disposed in a thicker portion of the catcher 230 adjacent the opening 231 as shown by the dashed lines 232*a*. The catcher 230 is releasably attached to the sock 200 via the plurality of shearable members 240. In some embodiments, and as shown in FIG. 2, a portion of the catcher 230 may be disposed within a tubular 201, such as tubular 201*c*, and tubular 221 of the catching assembly 220. As shown in FIG. 4, the catcher 230 is hollow. In some embodiments, the catcher 230 is not hollow. The catcher 230 is also shown in FIG. 2A.

Figure 5:
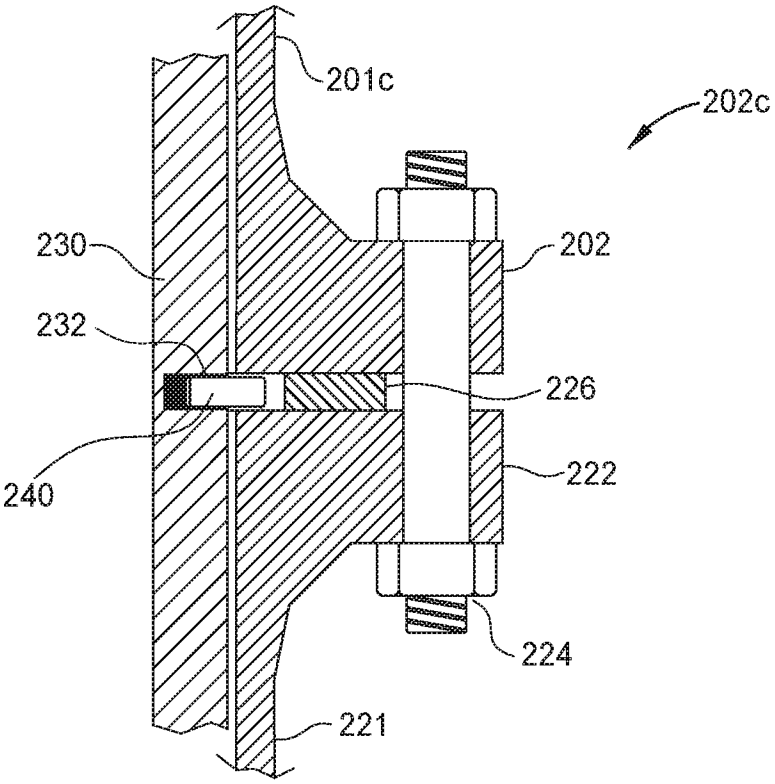
FIG. 5 illustrates a cross section of a connection between a first portion and a second portion of the sock.

FIG. 5 illustrates the connection 202*c* of the first portion 260 to the second portion 262. As shown in FIG. 5, the connection 202*c* between the first and second portions 260, 262 includes a releasable coupling between the catcher 230 and the remainder of the sock 200 to maintain the catcher 230 in a first position. In some embodiments, and as shown in FIG. 5, the shearable members 240 are partially disposed in the plurality of blind bores 232 and between the flanges 202, 222 of the flange connection 202*c*. Flange 202 is connected to or integral with the lower end of tubular 201*c*. Flange 222 is connected to or integral with the upper end of the tubular 221. The flanges 202, 222 are connected together by a plurality of fasteners 224, such as bolts. As shown, a spacer 226 can be placed between the two flanges 202, 222 of the flanged connection 202*c* such that the flanges 202, 222 are spaced apart to receive the portion of the shearable member 240. The flanges 202, 222 grip the shearable members 240. In some embodiments, the shearable members 240 are disposed partially in the blind bores 232 and bores formed through a wall of a tubular, such as tubular 221.

In an exemplary embodiment of placing the catcher 230 in the first position, shearable members 240 are first placed into the plurality of blind bores 232 (or circumferential groove). Then, the catcher 230 is lifted by a lifting tool and placed into the tubular 221. The catcher 230 is lowered relative to the tubular 221 until the shearable members 240 abut the flange 222. Then, the spacer 226 is placed on the flange 222. Then, the lifting tool is disconnected from the catcher 230. Then, the tubular 201*c* (or the entire first portion 260) is attached to the flange 222. For example, the tubular 201*c* is positioned such that the lower flange 202 is adjacent flange 222. Then the flanges 202, 222 are fastened together with the plurality of fasteners 224 to form the flanged connection 202*c*. The engagement of the flanges 202, 222 hold the shearable members 240 in place.

Figure 6A:
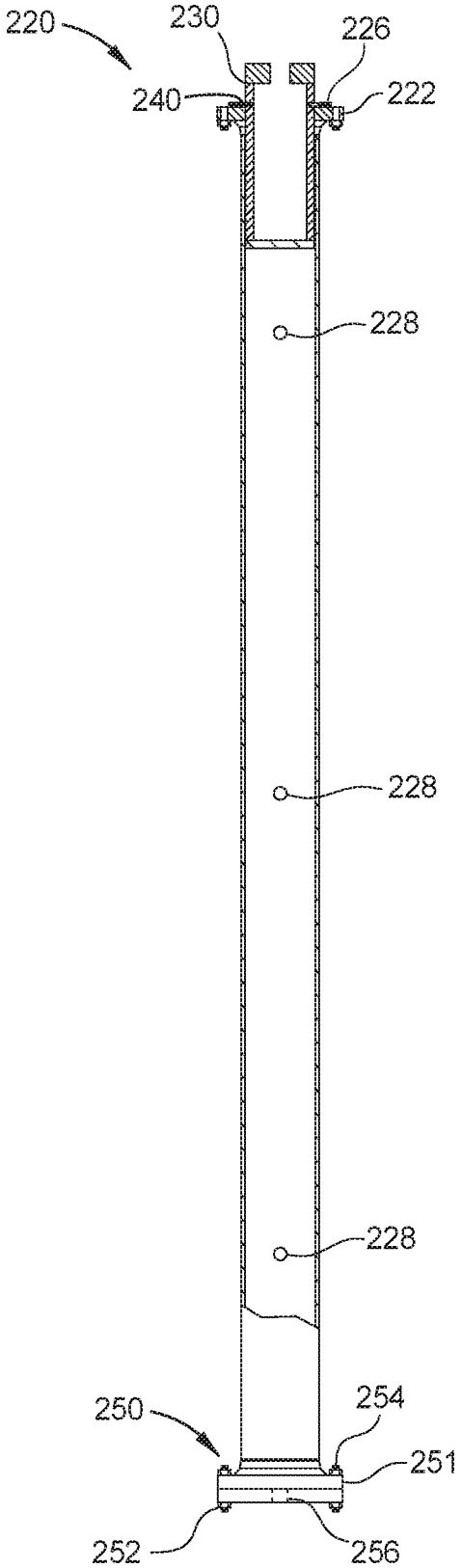
FIG. 6A-6B illustrates a partial cross-section of the second portion of the sock and illustrates the movement of a catcher from a first position to a second position.
Figure 6B:
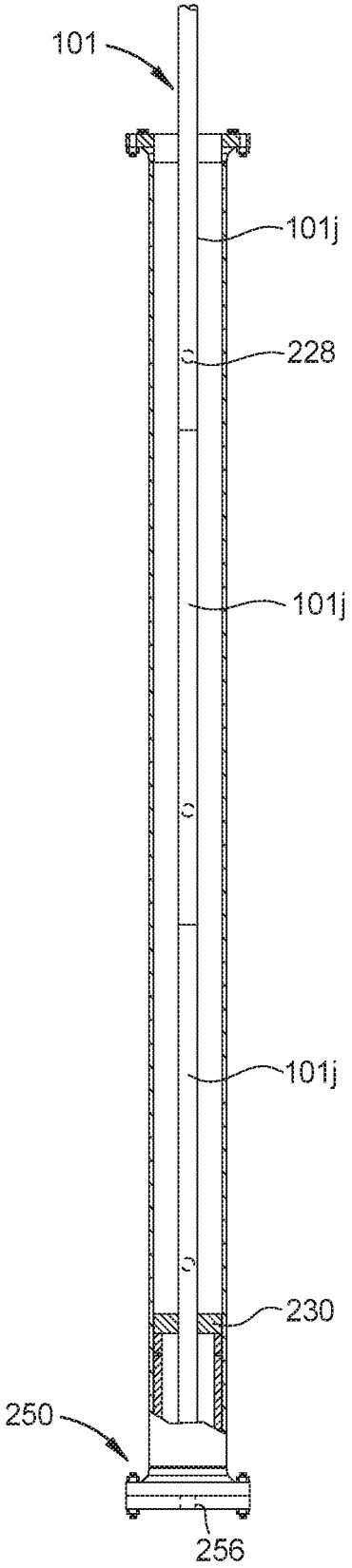

In some embodiments and as shown in FIGS. 6A-B, the tubular 221 is only one tubular. In some embodiments, the tubular 221 includes multiple tubulars connected together.

FIGS. 6A-6B illustrate a partial cross-section of the catching assembly 220. The stop flange 250 is disposed at the lower end of the catching assembly 220, such as at the lower end of the tubular 221. In some embodiments, and as shown in FIGS. 6A-6B, the stop flange 250 includes a first flange 251 and a second flange 252. The first flange 251 is integral with or coupled to the bottom end of the tubular 221. The second flange 252 is releasably coupled to the first flange 251. In some embodiments, the second flange 252 is coupled to the first flange 251 by a plurality of fasteners 254, such as bolts. In some embodiments and as shown in FIGS. 6A-6B, the second flange 252 has an aperture 256. In some embodiments, the aperture 256 may be about 2 inches (about 5.08 cm) to about 5 inches (about 12.7 cm) in diameter. In some embodiments, the second flange 252 has a plurality of apertures 256. The aperture 256 or plurality of apertures 256 of the stop flange 250 allow ocean water to flow into and out of the bore 204.

The section 101 is assembled in the sock 200 above the catcher 230. Preferably, the section 101 is assembled without contacting the catcher 230. A single joint 101*j*, such as an individual pipe, collar, or casing, may be dropped during an operation to assemble a section 101 in the sock 200. A section 101 may also be dropped before it is removed from the sock 200. A section 101 may also be dropped as the section 101 is removed from the sock 200. If a single joint 101*j* or section 101 is dropped into the sock 200 or dropped while at least partially disposed in the sock 200, the single joint 101*j* or section 101 may fall within the sock 200 until it impacts the catcher 230. For example, the single joint 101*j* or section 101 may impact the upper surface 233 of the catcher 230. The single joint 101*j* or section 101 may be received in the opening 231 of the catcher 230. The impact force of the dropped single joint 101*j* or section 101 may be sufficient to shear the plurality of shearable members 240, which causes the catcher 230 to detach. Once the shearable members 240 shear, the catcher 230 is free to move relative to the tubular 221. As shown in FIGS. 6A-6B, the catcher moves from the first position (FIG. 6A) to a second position (FIG. 6B). The catcher 230 is in the first position when it is held in place by the shearable members 240, such as by the coupling shown in FIG. 5. The catcher 230 is in the second position when the catcher 230 has contacted the stop flange 250, such as second flange 252, and can no longer continue to travel in the tubular 221.

As the catcher 230 moves from the first position to the second position, the catcher 230 displaces the column of fluid (e.g., water) that was in the bore 204 below the catcher 230. The displaced fluid flows from the bore 204 into the surrounding sea 102 through the plurality of orifices 228 and/or aperture(s) 256. The displacement of the fluid through the plurality of orifices 228 and/or the aperture(s) 256 slows the decent of the catcher 230 and the dropped single joint 101*j* or section 101 in the sock 200. Thus, as will be appreciated by one of ordinary skill in the art, the displacement of the fluid dissipates the energy of the impact of the dropped single joint 101*j* or section 101 with the catcher 230. The plurality of orifices 228, aperture(s) 256, and/or the length of the tubular 221 are configured such that the descent of the catcher 230 and the dropped single joint 101*j* or section 101 results in the catcher 230 landing on the stop flange 250, such as the second flange 252, without the stop flange 250 failing. As a result, the catcher 230 and the dropped single joint 101*j* or section 101 are not allowed to exit the sock 200. Thus, the dropped single joint 101*j* or section 101 is prevented from falling through the sea 102 and causing damage to equipment disposed on the seabed.

Once the dropped single joint 101*j* or section 101 and catcher 230 have stopped moving downwardly within the sock 200, the dropped single joint 101*j* or section 101 may be extracted. The dropped single joint 101*j* or section 101 may be extracted by a fishing tool. Once the dropped single joint 101*j* or section 101 has been extracted from the sock 200, an operation may be conducted to reset the catching assembly 220. For example, the sock 200 may be lifted by a crane of the offshore rig 100 after the sock 200 is coupled to the installation tool 500. If the support structure 208 is fastened to the support structure 308, then the connection is unfastened prior to lifting the sock 200. The sock 200 is lifted to a deck of the offshore rig 100, such as above the moon pool deck 104 or above the drill floor 103. Once lifted, the catching assembly 220 may be detached from the first portion 260. Then, the second flange 252 of the stop flange 250 may be detached from the first flange 251. The catcher 230 may then be removed from the tubular 221. Once the catcher 230 is removed, the second flange 252 is reattached to the first flange 251. The catcher 230 is inspected for damage. If the catcher 230 is still in a usable condition, then new shearable members 240 are inserted into the plurality of blind bores 232 (or circumferential groove) and the catcher 230 is lifted and inserted into to the top of the tubular 221. Then, the catching assembly 220 is then reattached to the other tubulars 201, such as tubular 201*c*, of the sock 200 via the flanged connection 202*c*. Once the catching assembly 220 is reattached, the sock 200 is returned to its deployment position ready for the assembly of new sections 101.

In some embodiments, the sock 200 is configured to catch a 30,000 lb (about 13,607.77 kg) joint 101*j* or section 101 that falls from a height of about 100 ft (about 30.48 m) above the catcher 230. In some embodiments; the sock 200 is sufficiently long enough to assembly a section 101 of about 81 ft (about 24.69 m) to about 96 ft (about 29.26) in length without contacting the catcher 230 during assembly of the section 101.

Referring back to FIG. 1, the sock 200 is shown deployed on the offshore rig 100. The upper end 203 of the sock is shown disposed below the second rotary table 152. In some embodiments, the upper end 203 is disposed in or above a rotary table, such as the second rotary table 152.

It is contemplated that the sock 200 can catch more than one dropped object, such as multiple dropped single joints 101*j* or multiple dropped sections 101. For example, the sock 200 can catch a dropped single joint 101 and a dropped section 101.

Figure 7:
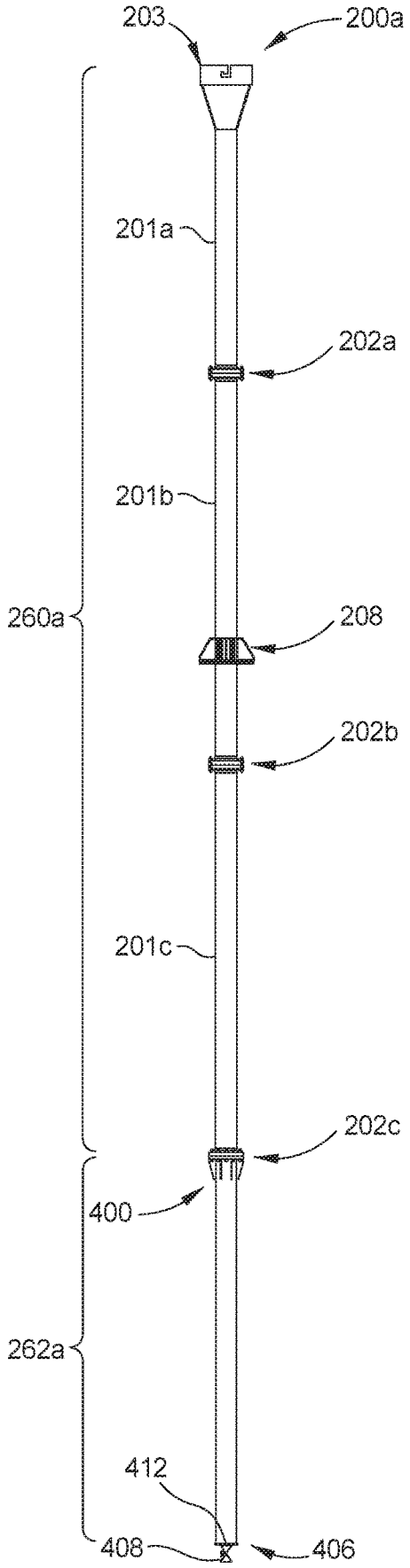
FIG. 7 illustrates an alternate embodiment of the sock.

FIG. 7 illustrates an alternative embodiment of the sock 200*a*. The sock 200*a* has a first portion 260*a* and a second portion 262*a*. The first portion 260*a* is substantially the same as the first portion 260 described above. The sock 200*a* differs from sock 200 in that the second portion 262*a* is a watertight assembly 400 instead of a catching assembly 220. The sock 200*a* is used during a core retrieval operation on the offshore rig 100. The sock 200*a* may have a diameter sufficient to accommodate the outer diameter of a coring tool.

As will be understood by one of ordinary skill in the art, core samples are obtained with a coring tool string. The coring tool string includes the coring tool connected at the end of a tubular string. The tubular string may be comprised of drill pipe. The coring tool may include a hollow coring bit. During retrieval of the core sample, the length of the coring tool string is reduced to a length, such as about 100 feet (about 30.48 m), that can be practically raised above a deck of the offshore rig 100, such as raising the coring tool above the first rotary table 150 disposed on the drilling floor 103. This reduced length of the coring tool string is then moved above the sock 200*a*, The reduced length of the coring tool string is then lowered into the sock 200*a*. The sock 200*a* provides a vertical and dry environment to complete the removal of the remaining tubular string from the coring tool. Because the final disassembly of the tubular string from the coring tool occurs while the coring tool is disposed in the sock 200*a*, the rotary table 150 is useable for subsequent coring or drilling operations. The coring tool, with the core sample disposed therein, may be stored in the sock 200*a* until the core is ready to be process or ready to be transported offsite for processing.

Figure 8:
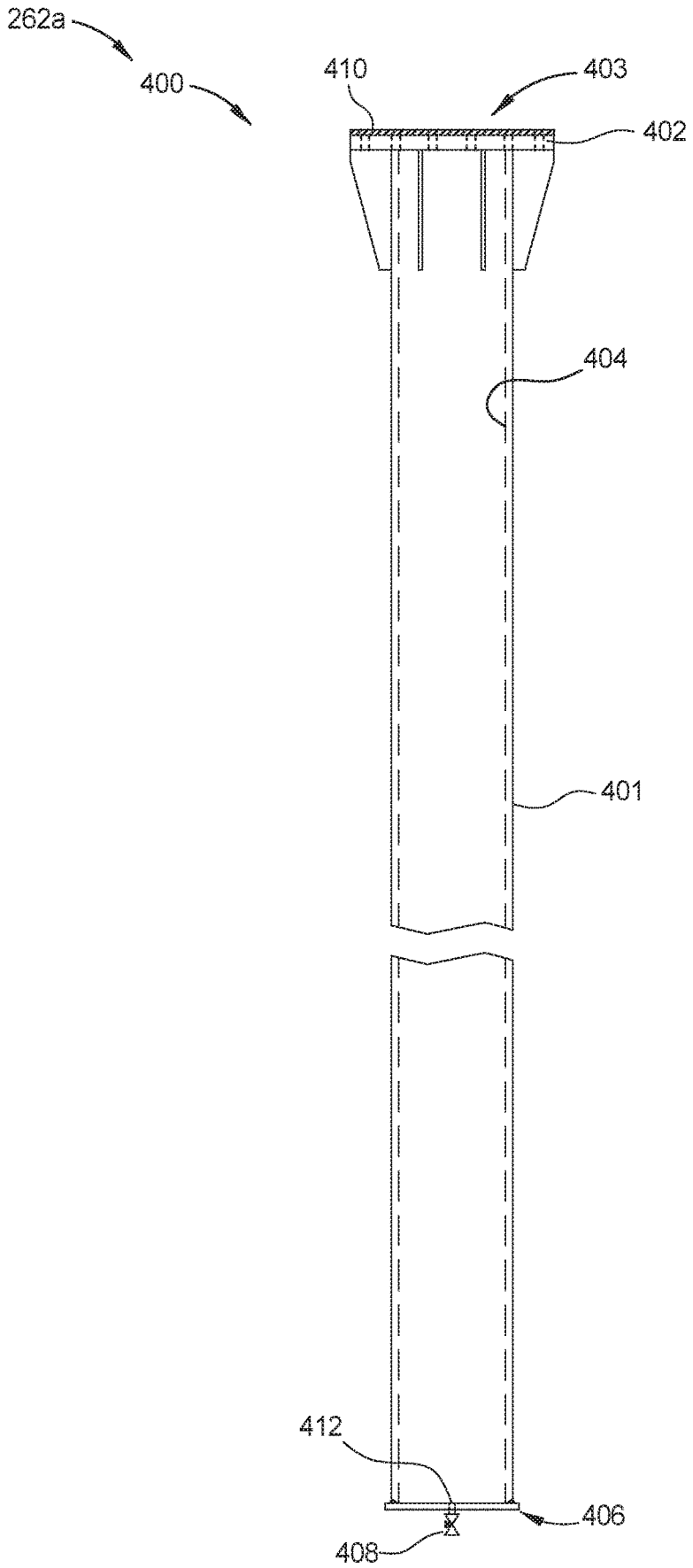
FIG. 8 illustrates a watertight assembly of the alternate embodiment of the sock.

FIG. 8 illustrates the watertight assembly 400. The watertight assembly 400 may be completely or partially submerged in the sea 102. The watertight assembly 400 includes a tubular 401, an open end 403, a bore 404, a closed end 406, a valve 408, and at least one sealing member 410. A flange 402 is connected to or integral with the upper end of the tubular 401. The bore 404 is closed at one end by the closed end 406 and open at the open end 403. For example, the closed end 406 may be a base plate welded to the lower end of the tubular 401. As shown in FIG. 8, the valve 408 is attached to the closed end 406 and in communication with a bore 412 formed through the closed end 406. The valve 408 may be selectively opened to allow communication with the bore 404. In some embodiments, and as shown in FIG. 8, the valve 408 is a needle valve. In some embodiments, the valve 408 is disposed in the closed end 406.

The watertight assembly 400 may be attached to the first portion 260*a* by a flanged connection. For example, the flange 402 is fastened to the bottom flange 202 of the tubular 201*c* by a plurality of fasteners, such as bolts. One or more sealing members 410 may be disposed between the flanges 202, 402. The one or more sealing members 410 may be a gasket. The one or more sealing members 410 seal the connection between the watertight assembly 400 and the first portion 260*a*. In some embodiments, the flanged connections 202*a-b* of the first portion 260*a* are unsealed because these flanged connections are not submerged in the sea 102.

Once the watertight assembly 400 is attached to the first portion 260*a*, the sock 200*a* lowered into the sea 102 to test the integrity of the seal of the sealing members 410. The sock 200*a* is lowered until the sealing members 410 are disposed below the surface of the sea 102. The valve 408 is closed during the test. The sock 200*a* may be supported by the cart 300 during the test. After the watertight assembly 400 is disposed in the sea 102 for a test duration, such as 1 hour, the sock 200*a* is raised until the watertight assembly 400 is disposed above the moon pool deck 104. The valve 408 is then opened. If water leaked into the watertight assembly 400 while submerged in the sea 102, then water will flow out the valve 408. If a leak occurred, then the watertight assembly 400 is detached from the first portion 260*a* and reattached. Subsequent testing occurs until a proper seal is verified. Once the seal of the sealing members 410 is verified, then the sock 200*a* can be deployed from the offshore rig 100 for a core retrieval operation. For example, the sock 200*a* can be suspended from the cart 300 with its upper end 203 disposed below the second rotary table 152. A portion of a coring tool string may be inserted into the sock 200*a* for storage and/or removal of the tubular string from the coring tool. The core sample may be disposed in the watertight assembly 400. The valve 408 is closed when the watertight assembly 400 is deployed in the sea 102.

Figure 9:
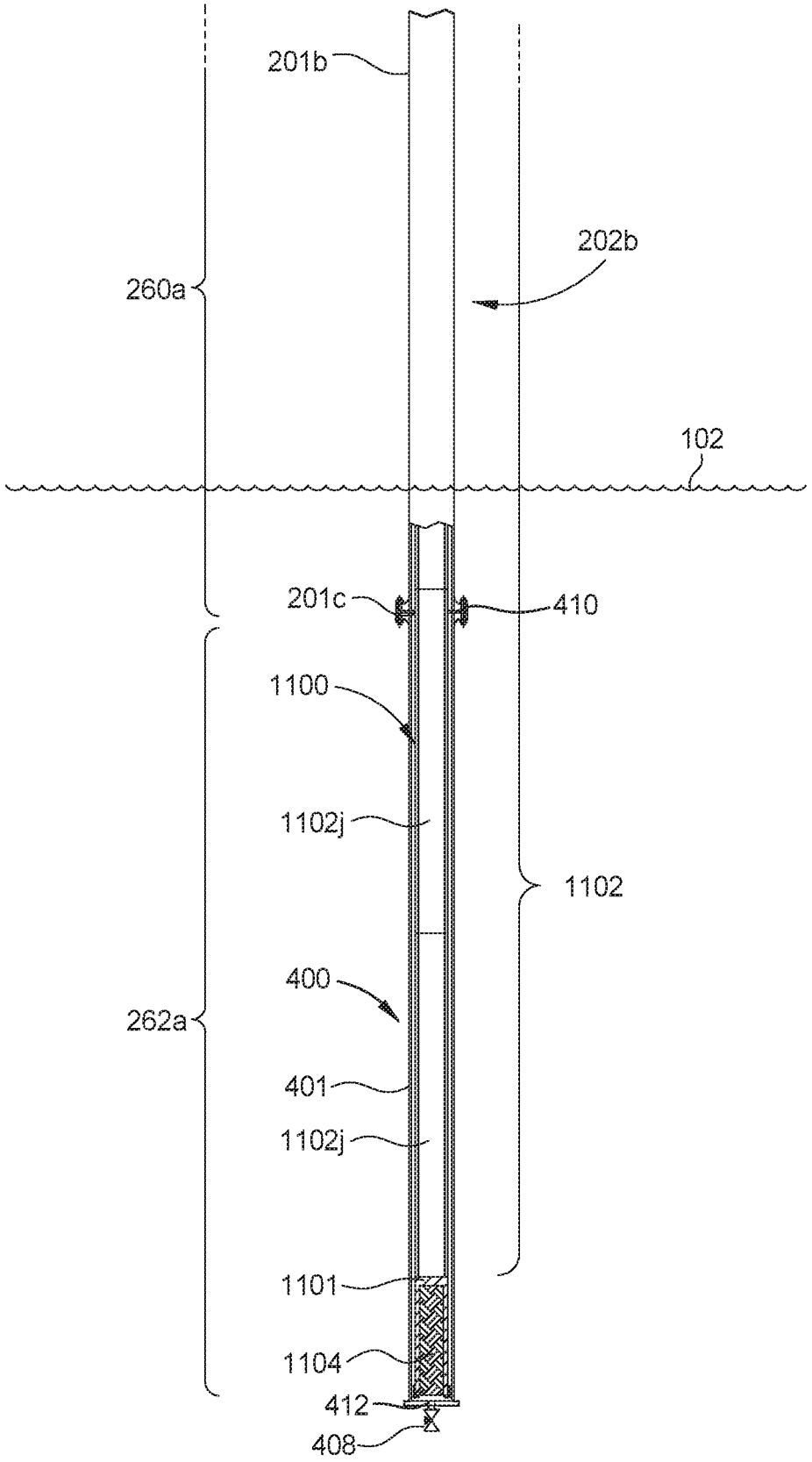
FIG. 9 illustrates a coring tool string disposed in the alternate sock.

FIG. 9 illustrates a schematic portion of a coring tool string 1100 disposed in the sock 200*a*. The coring tool string 1100 includes a coring tool 1101 connected to tubular string 1102. The coring tool 1101 includes a core sample 1104 disposed therein. The tubular string 1102 is composed of multiple joints of tubulars 1102*j*, such as drill pipe. The length of the coring tool string 1100 was reduced by removing tubulars 1102*j* until the length of the remaining coring tool string 1100 was of a length that could be handled on the offshore rig 100. The coring tool string 1100 was lifted and placed into the sock 200*a*. The remaining tubular joints 1102*j* may be removed from the coring tool string 1100 while the coring tool string 1100 is disposed in the sock 200*a*, For example the tubular joints 1102*j* may be removed using a tong assembly.

Figure 10B:
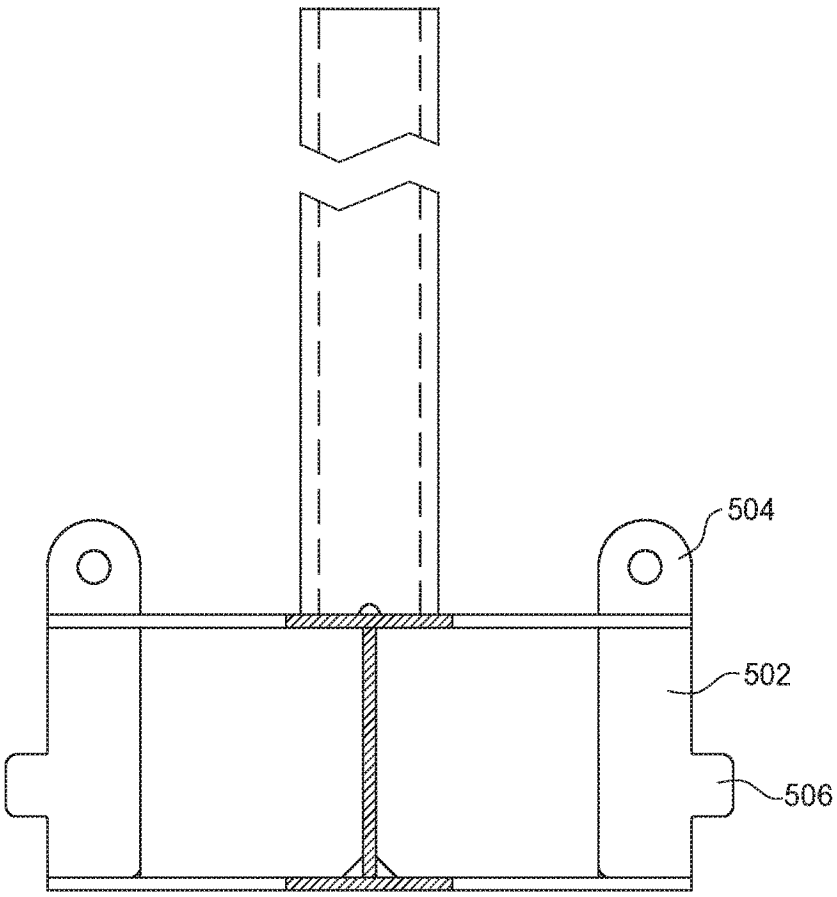
FIGS. 10A-B illustrates an installation tool used to lift and place the sock in position on the offshore rig.
Figure 10A:
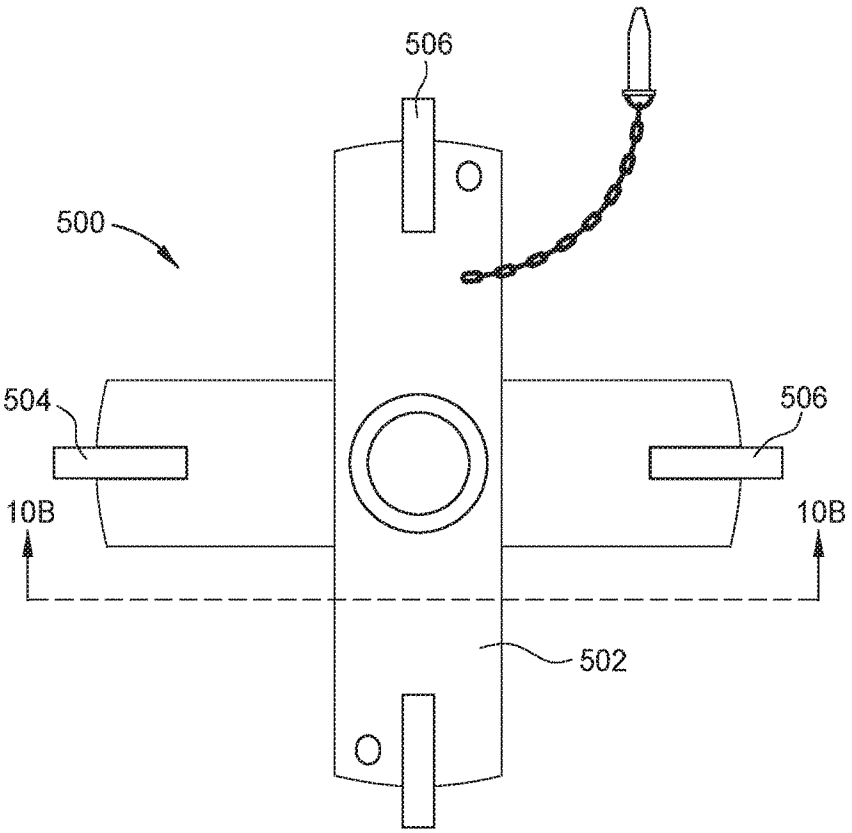

FIGS. 10A-B illustrate an exemplary installation tool. The installation tool 500 includes a body 502, padeyes 504, and connection members 506. The body 502 may be selectively coupled to a crane or rail lift system of the offshore rig 100. The padeyes 504 are configured to receive chains. In some embodiments, the chains are used by deck hands to position the installation tool 500. The connection members 506 may be pins. The connection members are configured to be received in the slots 212 of the sock 200, 200*a*. The slots 212 may be a j-slot as shown in FIG. 2. Once the connection members 506 are lowered in the slots 212, the installation tool 500 may be rotated such that the connection members 506 are located in the curve 212*c* of the j-slot 212. Once the connection members 506 are engaged with the slots 212, the installation tool 500 can be used to lift the sock 200, 200*a*.

In some embodiments, the tubulars 201, 221, and 401 are made from high strength steel pipe having an outer diameter of about 18 inches (about 45.72 cm) to about 30 inches (about 76.2 cm).

In some embodiments, the sock 200, 200*a* may be moved about the moon pool deck 104 by moving the cart 300 along the tracks 104*t*. For example, the clamps 310 of the cart 300 may be unset to move the cart 300 and the sock 200, 200*a* to a storage position.

It is contemplated that the sock 200, 200*a* could be used on floating platforms operating in bodies of fresh water.

In some embodiments, the support structure 308 may be retrofitted to an existing cart of the offshore rig 100. For example, a frame including the support structure 308 may be fastened to the existing cart.

In one embodiment, sock includes a plurality of tubulars coupled together and defining a bore. The sock further includes a catcher assembly. The catcher assembly includes a plurality of orifices formed in at least one of the plurality of tubulars. The catcher assembly further including a catcher releasably attached to the plurality of tubulars by a plurality of shearable members, wherein the catcher is disposed in the bore, and wherein the catcher is movable from a first position to a second position. The catcher assembly further including a stop flange having at least one aperture.

In some embodiments, each orifice of the plurality of orifices is about 0.5 inches to about 3 inches in diameter.

In some embodiments, the at least one aperture is a plurality of apertures.

In some embodiments, the at least one aperture is about 2 inches to about 5 inches in diameter.

In one embodiment, a method of catching a dropped pipe in a sock of a floating platform includes disposing a sock having a catcher, a stop flange having an aperture, and a plurality of orifices at least partially in a body of water. The catcher is releasably attached to the sock via a plurality of shearable members. The method further includes releasing the catcher from the sock by shearing the plurality of shearable members in response to the impact of a dropped pipe with a portion of the catcher. The method further includes displacing a column of water from a bore of the sock through at least one of the plurality of orifices and/or the aperture in response to the catcher descending in the bore of the sock. The method further includes engaging the catcher with the stop flange.

In some embodiments of the method, the method includes, lifting the sock out of the body of water after engaging the catcher with the stop flange.

In some embodiments of the method, the method includes removing a portion of the stop flange.

In some embodiments of the method, the method includes removing the catcher form the sock.

In some embodiments of the method, the method includes reattaching the catcher to the sock with a new plurality of shearable fasteners.

In some embodiments of the method, the method includes disposing the sock with the reattached catcher at least partially in the body of water.

In some embodiments of the method, the floating platform is an offshore rig.

In some embodiments of the method, the sock is supported from the floating platform with a cart.

In some embodiments of the method, the cart is a blowout preventer cart.

In one embodiment, a sock assembly includes the sock 200, 200*a* and the cart 300.

In one embodiment, a method of retrieving a core includes deploying a sock from a floating platform, the sock having a first portion and a second portion, wherein the second portion is a water tight assembly. The method further includes disposing a coring tool string in the sock, wherein the coring tool string including a coring tool and a tubular string composed of individual joints of tubulars, wherein a core retrieved from the seabed is disposed in the coring tool.

In some embodiments of the method of retrieving the core, prior to disposing the coring tools string in the sock, the method further includes testing a seal of the water tight assembly by lowering the watertight assembly into the sea and then lifting the watertight assembly above the sea. A valve of the water tight assembly is opened once the watertight assembly is lifted above the sea to determine if sea water leaked into the sock.

In some embodiments of the method of retrieving the core, deploying the sock includes suspending the sock from a cart on a moon pool deck of the offshore rig.

In some embodiments of the method of retrieving the core, the method further includes removing the tubular string from the coring tool while the coring tool is disposed in the sock.

In one embodiment, a sock for a floating platform includes a plurality of tubulars coupled together and defining a bore, and a catching assembly. The catching assembly includes a plurality of orifices formed in at least one of the plurality of tubulars. The catching assembly further includes a catcher releasably coupled to the plurality of tubulars by a plurality of shearable members, wherein the catcher is disposed in the bore, and wherein the catcher is movable from a first position to a second position. The catching assembly further includes a stop flange having at least one aperture.

In some embodiments, each orifice of the plurality of orifices is about 0.5 inches to about 3 inches in diameter.

In some embodiments, the at least one aperture is a plurality of apertures.

In some embodiments, the at least one aperture is about 2 inches to about 5 inches in diameter.

In some embodiments, the stop flange is a first flange fastenable to a second flange, wherein the second flange includes the at least one aperture.

In some embodiments, the catcher includes a plurality of blind bores, wherein a respective shearable member is partially disposed in a respective blind bore.

In some embodiments, the plurality of shearable members are partially disposed between a first flange connected to the first tubular of the plurality of tubulars and a second flange connected to the at least one of the plurality of tubulars including the plurality of orifices, wherein a spacer is disposed between the first flange and the second flange.

In some embodiments, at least one of the tubulars includes a first support structure configured to be engaged with a second support structure of a cart configured to support the weight of the sock.

In one embodiment, a method of using a sock on a floating platform includes disposing a sock having a catcher, a stop flange having an aperture, and a plurality of orifices at least partially in a body of water, wherein the catcher is maintained in a first position by a plurality of shearable members. The method further includes releasing the catcher from the first position by shearing the plurality of shearable members in response to an impact of a dropped joint with a portion of the catcher. The method further includes displacing a column of water from a bore of the sock through at least one of the plurality of orifices and the aperture in response to the catcher descending in the bore. The method further includes engaging the catcher with the stop flange.

In some embodiments, the method of using the sock on the floating platform includes lifting the sock out of the body of water after engaging the catcher with the stop flange.

In some embodiments, the method of using the sock on the floating platform includes removing a portion of the stop flange and removing the catcher from the bore of the sock after removing the sock out of the body of water.

In some embodiments, the method of using the sock on the floating platform includes reattaching the catcher to the sock with a new plurality of shearable fasteners.

In some embodiments, the method of using the sock on the floating platform includes disposing the sock with the reattached catcher at least partially in the body of water.

In some embodiments of the method of using the sock on the floating platform, disposing the sock the sock at least partially in the body of water induces supporting the sock from a cart.

In some embodiments of the method of using the sock on the floating platform, the cart is a blowout preventer cart.

In one embodiment, a sock for a core retrieval operation includes a first portion including one or more tubulars and a second portion. The second portion includes a first tubular having a upper end and a lower end, wherein the upper end is open and the lower end is closed. The second portion further includes a coupling connected to the upper end configured to couple the second portion to the first portion. The second portion further includes at least one sealing member configured to seal the coupling between the first portion and the second portion. The second portion further includes a valve coupled to the lower end, the valve configured to selectively allow fluid communication with an interior of the first tubular.

In some embodiments of the sock, the first portion includes a support structure configured to be engaged with a second support structure of a cart.

In some embodiments of the sock, the lower end is closed by a base plate.

In some embodiments of the sock, the valve is disposed in the base plate.

In some embodiments of the sock, wherein the at least one sealing member a gasket.

While the foregoing is directed to embodiments of the present disclosure, other and further embodiments of the disclosure may be devised without departing from the basic scope thereof, and the scope thereof is determined by the claims that follow,

What is claimed is:

1. A sock for a floating platform, comprising:

a first portion including a plurality of first tubulars coupled together; and a second portion connected to the lower end of the first portion, wherein the second portion comprises a catching assembly having:

a second tubular;

a plurality of orifices formed in the second tubular;

a catcher releasably coupled to the second tubular by a plurality of shearable members, wherein the catcher is disposed in a bore defined by the plurality of first tubulars and second tubular, and wherein the catcher is movable from a first position to a second position; and a stop flange having at least one aperture.

2. The sock of claim 1, wherein each orifice of the plurality of orifices is about 0.5 inches to about 3 inches in diameter.

3. The sock of claim 1, wherein the at least one aperture is a plurality of apertures.

4. The sock of claim 1, wherein the at least one aperture is about 2 inches to about 5 inches in diameter.

5. The sock of claim 1, wherein the stop flange is a first flange fastenable to a second flange, wherein the second flange includes the at least one aperture.

6. The sock of claim 1, wherein the catcher includes a plurality of blind bores, wherein a respective shearable member is partially disposed in a respective blind bore.

7. The sock of claim 1, wherein the plurality of shearable members are partially disposed between a first flange connected to the first tubular of the plurality of tubulars and a second flange connected to the second tubular, wherein a spacer is disposed between the first flange and the second flange.

8. The sock of claim 1, wherein at least one of the tubulars includes a first support structure configured to be engaged with a second support structure of a cart configured to support the weight of the sock.

9. A method of using a sock on a floating platform, comprising:

disposing a sock having a catcher, a stop flange having an aperture, and a plurality of orifices at least partially in a body of water, wherein the catcher is maintained in a first position by a plurality of shearable members;

releasing the catcher from the first position by shearing the plurality of shearable members in response to an impact of a dropped joint with a portion of the catcher;

displacing a column of water from a bore of the sock through at least one of the plurality of orifices and the aperture in response to the catcher descending in the bore;

engaging the catcher with the stop flange.

10. The method of claim 9, further comprising:
after engaging the catcher with the stop flange, lifting the sock out of the body of water.

11. The method of claim 10, further comprising:
after removing the sock out of the body of water:
removing a portion of the stop flange; and
removing the catcher from the bore of the sock.

12. The method of claim 11, further comprising:
reattaching the catcher to the sock with a new plurality of shearable fasteners.

13. The method of claim 12, further comprising:
disposing the sock with the reattached catcher at least partially in the body of water.

14. The method of claim 9, wherein disposing the sock at least partially in the body of water induces supporting the sock from a cart.

15. The method of claim 14, wherein the cart is a blowout preventer cart.

16. A sock for a core storage, comprising:
a first portion including one or more tubulars; and
a second portion including:
a first tubular having an unobstructed bore configured to receive a coring tool, a upper end, and a lower end, wherein the upper end is open and the lower end is closed, and wherein the unobstructed bore extends from the upper end to the lower end;
a coupling connected to the upper end configured to couple the second portion to the first portion;
at least one sealing member configured to seal the coupling between the first portion and the second portion; and
a valve coupled to the lower end, the valve configured to selectively allow fluid communication with an interior of the first tubular.

17. The sock of claim 16, wherein the first portion includes a support structure configured to be engaged with a second support structure of a cart.

18. The sock of claim 16, wherein the lower end is closed by a base plate.

19. The sock of claim 18, wherein the valve is disposed in the base plate.

20. The sock of claim 16, wherein the at least one sealing member is a gasket.

* * * * *